US008739990B2

(12) United States Patent
Radmall

(10) Patent No.: US 8,739,990 B2
(45) Date of Patent: Jun. 3, 2014

(54) UPRIGHT SUPPORT FOR GANTRY

(75) Inventor: Paul Radmall, Marlborough (NZ)

(73) Assignee: Reid Lifting Limited

( * ) Notice: Subject to any disclaimer, the term of this patent is extended or adjusted under 35 U.S.C. 154(b) by 745 days.

(21) Appl. No.: 12/918,760

(22) PCT Filed: Feb. 20, 2009

(86) PCT No.: PCT/GB2009/000467
§ 371 (c)(1),
(2), (4) Date: Feb. 21, 2011

(87) PCT Pub. No.: WO2009/103986
PCT Pub. Date: Aug. 27, 2009

(65) Prior Publication Data

US 2011/0132861 A1 Jun. 9, 2011

(30) Foreign Application Priority Data

Feb. 20, 2008 (GB) ..... 0803120.5

(51) Int. Cl.
*B66C 5/02* (2006.01)

(52) U.S. Cl.
USPC ..... 212/324; 212/294

(58) Field of Classification Search
CPC ..... B66C 5/04; B66C 19/02
USPC ..... 212/312, 319, 324, 294
See application file for complete search history.

(56) References Cited

U.S. PATENT DOCUMENTS

| | | | | |
|---|---|---|---|---|
| 1,352,035 A | | 7/1920 | Smith | |
| 2,784,005 A | * | 3/1957 | Abgarian | 280/645 |
| 2,995,094 A | * | 8/1961 | Wallace | 104/126 |
| 3,211,113 A | * | 10/1965 | Randall | 108/9 |
| 3,741,338 A | | 6/1973 | Durand et al. | |
| 3,826,196 A | | 7/1974 | Wallace | |
| 3,954,155 A | * | 5/1976 | Guidara | 182/20 |

(Continued)

FOREIGN PATENT DOCUMENTS

| | | | |
|---|---|---|---|
| FR | 2140960 A5 | | 1/1973 |
| GB | 149 997 | | 11/1921 |
| GB | 2 293 811 | | 4/1996 |
| GB | 2490926 A | * | 11/2012 |

OTHER PUBLICATIONS

International Search Report for International Application No. PCT/GB2009/000467 mailed May 4, 2009.

(Continued)

*Primary Examiner* — Emmanuel M Marcelo
(74) *Attorney, Agent, or Firm* — Marshall, Gerstein & Borun LLP

(57) ABSTRACT

An upright support assembly for a gantry includes a base with primary ground engaging means, such as wheels and a stabilizing member which is pivotally connected to the support assembly so as to be moveable between a stowed position folded against the support assembly and a deployed position in which it engages the ground to hold the support assembly upright. The stabilizing member includes a ground engaging fitting at its outer end which is adapted to engage the ground in the deployed position to stabilize the support assembly in the upright position, and to engage and roll over the ground in the stowed position when the support assembly is lowered to the ground so that the base and primary ground engaging means can be lifted off the ground and the support assembly moved on the ground engaging fitting.

6 Claims, 4 Drawing Sheets

(56) References Cited

U.S. PATENT DOCUMENTS

| | | | | | |
|---|---|---|---|---|---|
| 4,041,875 | A * | 8/1977 | Wallace | 104/126 |
| 4,334,480 | A * | 6/1982 | Wallace | 104/126 |
| 4,445,665 | A | 5/1984 | Cray | |
| 4,538,709 | A * | 9/1985 | Williams et al. | 190/18 A |
| 4,648,778 | A | 3/1987 | Schultz | |
| 4,718,563 | A * | 1/1988 | Ellgass | 212/343 |
| 5,090,667 | A | 2/1992 | Harrell | |
| 5,597,081 | A * | 1/1997 | Shirley | 212/299 |
| 5,603,491 | A * | 2/1997 | Murrell | 269/15 |
| 5,746,683 | A * | 5/1998 | Lee | 482/57 |
| 5,830,113 | A * | 11/1998 | Coody et al. | 482/54 |
| 5,904,637 | A * | 5/1999 | Kuo | 482/54 |
| 5,979,928 | A * | 11/1999 | Kuo | 280/642 |
| 6,009,927 | A * | 1/2000 | Peters | 156/577 |
| 6,533,135 | B1 * | 3/2003 | Ford et al. | 212/294 |
| 6,578,722 | B2 * | 6/2003 | Perkins et al. | 212/180 |
| 6,637,610 | B1 * | 10/2003 | Cheeseboro | 212/327 |
| 6,705,821 | B2 * | 3/2004 | Philipps et al. | 414/462 |
| 7,080,814 | B1 * | 7/2006 | Brooks | 248/441.1 |
| 7,428,759 | B2 * | 9/2008 | Bain et al. | 5/86.1 |
| 7,604,134 | B2 * | 10/2009 | Lichinchi | 212/175 |
| 7,997,845 | B2 * | 8/2011 | Carlei | 414/10 |
| 2008/0070756 | A1 * | 3/2008 | Chu | 482/54 |
| 2008/0150244 | A1 * | 6/2008 | Carlei | 280/35 |
| 2008/0159831 | A1 * | 7/2008 | Davis | 414/140.3 |
| 2008/0200314 | A1 * | 8/2008 | Dalebout et al. | 482/52 |
| 2009/0050187 | A1 * | 2/2009 | Lamb | 135/67 |

OTHER PUBLICATIONS

Patents Act 1977: Search Report under Section 17(5) for Application No. GB0803120.5 dated Jan. 30, 2009.

* cited by examiner

UPRIGHT SUPPORT FOR GANTRY

BACKGROUND

1. Field of the Invention

This disclosure relates generally to an upright support suitable for use in a gantry.

2. Related Technology

A gantry comprises two upright side frames connected by a horizontal beam supporting a beam trolley that runs along the beam and is fitted with a hoist to lift loads. Gantries are commonly made so that they are mobile to allow them to be located over loads that require lifting. For this purpose, the side frames are each fitted with wheels to contact the ground. An example of such a gantry is shown in FIG. 1.

For a gantry to be portable, it is necessary to disassemble the side frames from the horizontal beam and to transport each component separately. A side frame may be readily moveable on the wheels at its base but will not be stable enough in an upright state to allow it to be moved safely, especially if it is large and heavy.

SUMMARY OF THE INVENTION

An object of the invention is to adapt the side frame of a gantry to make it more readily transportable.

According to a first aspect, an upright support assembly includes a base with primary ground engaging means and a stabilizing member which is pivotally connected to the support assembly so as to be moveable between a stowed position folded against the support assembly and a deployed position in which it engages the ground to hold the support assembly upright, the stabilizing member carrying a ground engaging fitting at its outer end which is adapted to engage the ground in the deployed position to stabilize the support assembly in the upright position, and to engage and roll over the ground in the stowed position when the support assembly is lowered to the ground so that the base and primary ground engaging fittings can be lifted off the ground and the support assembly moved on the ground engaging fitting.

According to a second aspect, the ground engaging fitting therefore serves a dual function in stabilizing the support assembly in its upright state and allowing transport of the support assembly in a lowered state.

According to a third aspect, the supplementary ground engaging fitting includes a castor with a directional lock that is intended to be operated to stop castoring when the support assembly is being transported in the lowered state, but which is intended to be non-operative to allow castoring when the support assembly is moved in the upright state with the stabilizing member deployed.

BRIEF DESCRIPTION OF THE DRAWINGS

The invention will now be described by way of example with reference to the accompanying drawings in which.

DETAILED DESCRIPTION

Figure 1:
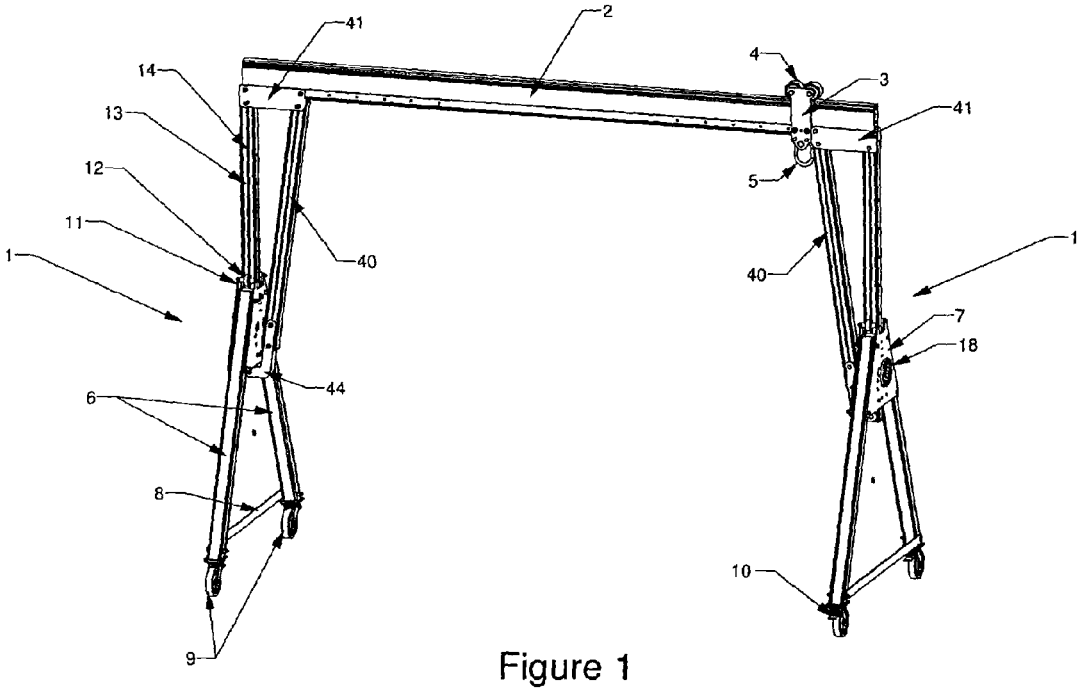
FIG. 1 is a general view of a mobile gantry.

The gantry shown in FIG. 1 comprises two upright side frames 1 connected by a horizontal beam 2 supporting a beam trolley 3 that runs along the beam on wheels 4 and has a lifting eye 5 for a hoist. The side frames 1 each comprise a pair of legs 6 joined at their top by a pair of connecting plates 7 which diverge downwards and are connected at their bottom by a tie bar 8. A castor wheel 9 is connected to the bottom of each leg 6 and is provided with a brake 10. The legs 6 are tubular with a rectangular section and their side faces abut the plates 7 either side.

The plates 7 are of a generally triangular shape to match the profile of the diverging legs 6 and each have a pair of upwardly projecting lugs 11 at their upper end to form mounting points for a pair of guide wheels 12 located between respective pairs of lugs 11 either side of a central vertical gap between the two plates. This gap is designed to receive an upright adjustable support 13, the top of which is connected to one end of the horizontal beam 2. The support 13 is a tubular member with a substantially rectangular section and has channels 14 formed longitudinally in opposite sides. A roller link chain (not shown) is fitted in one of these channels for engagement by a drive gear (not shown) to determine the vertical position of the support 13. The drive gear is mounted on a drive spindle (not shown) between the two plates 7, and a hand wheel 18 is mounted on the spindle outboard of the outer plate 7 so as to be accessible for operation by a user to drive a drive gear (not shown) and adjust the vertical position of the support 13.

In order to increase lateral stability of the gantry, a strut member 40 is provided between the beam 2 and each side frame 1. The strut 40 comprises a tubular member similar to the support 13 and is connected at its lower end to the lower end of the support 13 where it projects below the plates 7. This connection 44 then limits the extent to which the support 13 and beam 2 can be raised vertically. The upper end of the strut 40 is connected to the beam 2 inboard of the support 13 via connection plates 41 either side.

When the gantry requires transporting to another location to which it cannot be easily moved ready assembled on the wheels 9, it is disassembled by disconnecting the plates 41 from the beam 2 so that the side frames 1 and beam 2 can be transported separately. In order to assist transportation of the side frames 1, each is fitted with a stabilizing assembly 20 as shown in FIGS. 2 to 5.

Figure 2:
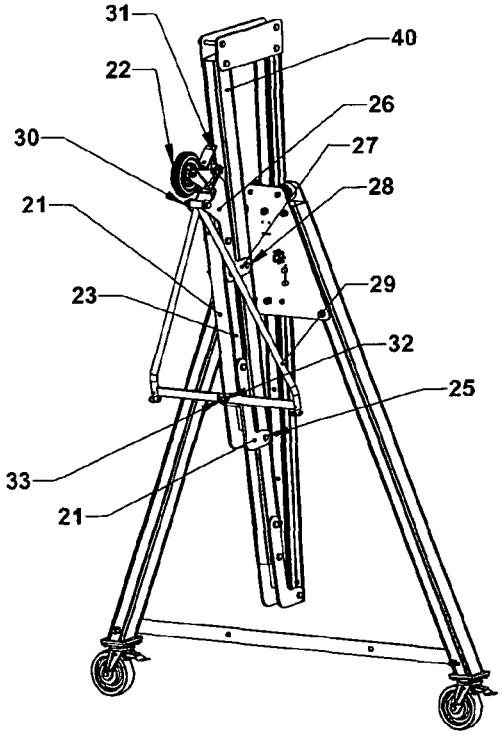
FIG. 2 is a view of an upright side frame of the gantry of FIG. 1 modified to incorporate a stabilizing member according to the invention, shown in a stowed position.
Figure 3:
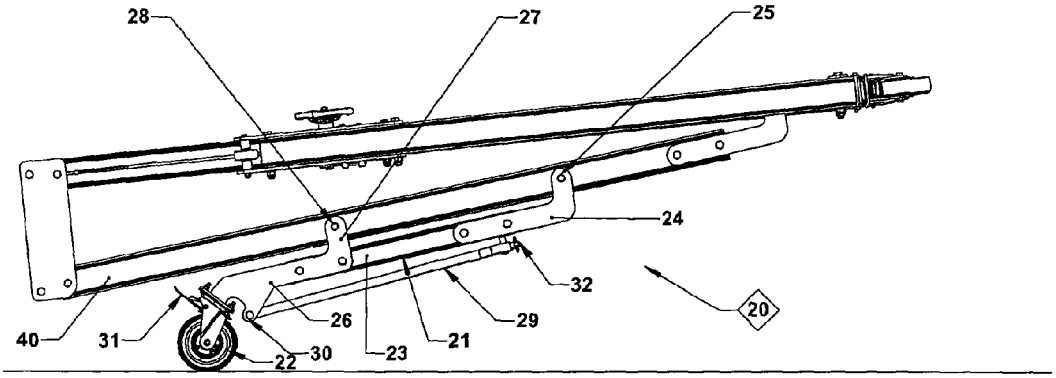
FIG. 3 is a side view of the upright side frame of FIG. 2 showing how it is transportable in a lowered state.

The stabilizing assembly 20 has a stabilizing leg 21 which is pivotally connected to the strut 40 at one end and which carries a castor wheel 22 at its outer end. The stabilizing leg comprises a central tubular portion 23 with a pair of extension plates 24 either side at the inner end that embrace the strut 40 and are connected thereto by a pivot pin 25. The extension plates 24 are cranked so as to allow the leg 21 to be pivoted upwards against the strut 40 as shown in FIGS. 2 and 3. The castor wheel 22 is mounted on a second pair of extension plates 26 at the outer end of the tubular member 23, and a pair of lugs 27 extend laterally from the plates 26 so as to engage either side of the strut 40 when the stabilizing leg is in its stowed position folded against the strut 40. A fastening pin 28 is inserted through aligned holes in the lugs 27 and strut 401 to secure the stabilizing leg in the stowed position.

Figure 4:
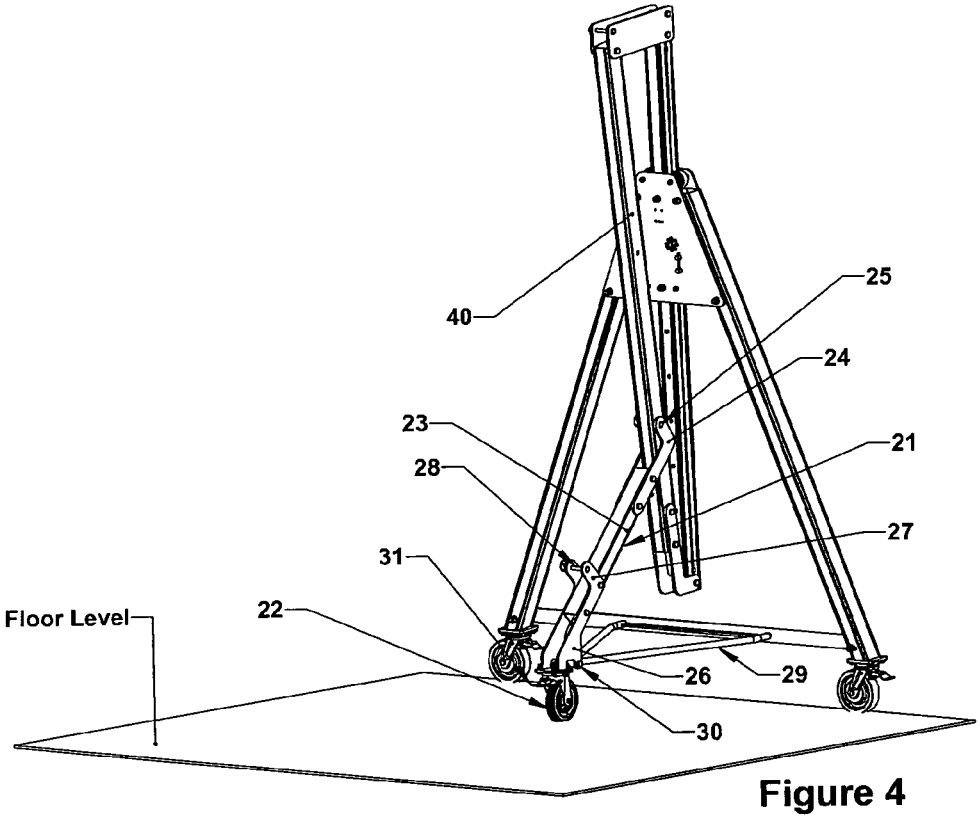
FIG. 4 is a view of the upright side frame of FIG. 2 with the stabilizing member shown in a deployed position to stabilize the upright side frame in the upright position.

When the stabilizing leg needs to be deployed, the fastening pin 28 is removed and the leg is pivoted down to a deployed position as shown in FIG. 4, and a V-shaped stay 29 is connected between the outer end of the stabilizing leg and the tie bar 8 of the side frame. The stay 29 is pivotally fastened to lugs 30 on the extension plates 26 at its pointed end, and is secured by releasable fasteners 32 to the tie 8 at each end. When not in use, the stay 29 is folded up against the leg 21 and held in position by a lug and pin 33. With the stabilizing leg 21 deployed and the side frame upright, the castor wheel 22 engages the ground, and together with the castor wheels 9 of the side frame form a stable wheeled base on which the side frame can be moved freely in any direction by operators. The castor wheel 22 incorporates a directional lock 31 which is released to allow the castoring action; but which can be operated to lock the wheel against castoring for reasons explained below.

This mode of transport with the side frame 1 upright and the stabilizing leg deployed, is suitable for movement over smaller distances or in confined spaces where the side frame needs to be kept upright. However, when it is required to transport the side frame over greater distances it is more convenient and safer to release the stay 29 and fold the stabilizing leg upwards into the stowed position and secure it against the strut 40 with the fastening pin 28. The side frame can then be laid down so that the castor wheel 22 engages the ground. The castor wheel is locked to prevent the castoring action. Two operators can then each take hold of the end of tie bar 8 and lift it off the ground so that the side frame is supported on the wheel 22 and can be wheeled on this to a new position. The side frame is effectively moved in the manner of a wheel barrow, and because of its low centre of gravity it is safe and easy to handle. At a new location it is then a simple matter to lock the wheels 9 and raise the side frame to the upright position for connection to the horizontal beam 2. The stabilizing leg 21 may be lowered to the deployed position to help support it whilst connecting the beam 2 if desired.

It will be appreciated that the reference to an "upright" support assembly herein, should not be construed as a limitation but only serves to describe the state of the support assembly in normal use.

The invention claimed is:

1. A gantry comprising two side frames connected by a beam, wherein at least one of the side frames comprises:

a base with primary ground engaging means; and a stabilizing member which is pivotally connected to the at least one side frame so as to be moveable between a stowed position folded against the at least one side frame and a deployed position in which it engages the ground to hold the at least one side frame upright, the stabilizing member carrying a ground engaging fitting at its outer end which is adapted to engage the ground in the deployed position to stabilize the at least one side frame in the upright position, and to engage and roll over the ground in the stowed position when the at least one side frame is lowered to the ground so that the base and primary ground engaging means can be lifted off the ground and the at least one side frame moved on the ground engaging fitting.

2. A gantry as claimed in claim 1 in which the ground engaging fitting engages and rolls over the ground in the deployed position.

3. A gantry as claimed in claim 2 in which the ground engaging fitting comprises a castor with a directional lock that is intended to be operated to stop castoring when the at least one side frame is being transported in the lowered state, but which is intended to be released to allow castoring when the at least one side frame is moved in the upright state with the stabilizing member deployed.

4. A gantry as claimed in claim 1 comprising a stay which is releasably connectable between the outer end of the stabilizing member and the at least one side frame to hold the stabilizing member in the deployed position.

5. A gantry as claimed in claim 1 in which the stabilizing member is lockable in the stowed position.

6. A support assembly for use as a side frame of a gantry, the support assembly comprising the at least one side frame according to claim 1.

* * * * *